US006371023B1

(12) United States Patent
Francille

(10) Patent No.: US 6,371,023 B1
(45) Date of Patent: Apr. 16, 2002

(54) INTEGRATED GUIDING DEVICE FOR PRINTING FERRULE OR ROLLER AND FERRULE OR ROLLER EQUIPPED THEREWITH

(75) Inventor: Jean Francille, Pons (FR)

(73) Assignee: Societe Seites, Pons (FR)

( * ) Notice: Subject to any disclaimer, the term of this patent is extended or adjusted under 35 U.S.C. 154(b) by 0 days.

(21) Appl. No.: 09/446,751

(22) PCT Filed: Jun. 23, 1998

(86) PCT No.: PCT/FR98/01306

§ 371 Date: Dec. 27, 1999

§ 102(e) Date: Dec. 27, 1999

(87) PCT Pub. No.: WO98/58803

PCT Pub. Date: Dec. 30, 1998

(30) Foreign Application Priority Data

Jun. 24, 1997 (FR) ..... 97 08163

(51) Int. Cl.[7] ..... B41F 13/10

(52) U.S. Cl. ..... 101/375; 101/378; 101/415.1

(58) Field of Search ..... 101/375, 374, 101/378, 381, 382.1, 386, 400, 401, 401.1, 402, 415

(56) References Cited

U.S. PATENT DOCUMENTS 1,961,797 A * 6/1934 Smith ..... 101/386
2,229,133 A * 1/1941 Sands ..... 101/383
3,001,472 A * 9/1961 Parrish ..... 101/378
3,126,825 A * 3/1964 Tofano ..... 101/378
4,515,375 A * 5/1985 Bleckmann et al. ..... 101/378
5,379,693 A * 1/1995 Hoffmann et al. ..... 101/375
5,488,903 A * 2/1996 Köbler et al. ..... 101/375
6,101,941 A * 8/2000 Aubert et al. ..... 101/378
6,116,160 A * 9/2000 Burn et al. ..... 101/378

FOREIGN PATENT DOCUMENTS

DE 351-2776 A1 * 10/1986
EP 0-170956 * 7/1985
EP 0523-346 A1 * 1/1993

* cited by examiner

*Primary Examiner*—Eugene Eickholt
(74) *Attorney, Agent, or Firm*—Young & Thompson

(57) ABSTRACT

The object of the invention is an integrated guiding device for positioning and cutting with the help of a cutting tool, a printing plate (16) on a sleeve (10) or on a printing cylinder, particularly for flexography, said sleeve or cylinder comprising an external coating (24) adapted to be deeply machined, characterized in that it comprises at least one longitudinal guide (30) along a generatrix, and/or a peripheral guide, along a circumference, provided within a matrix of material of high hardness, embedded in the thickness of said external coating.

The invention also comprises the sleeve or cylinder provided with this device.

8 Claims, 2 Drawing Sheets

INTEGRATED GUIDING DEVICE FOR PRINTING FERRULE OR ROLLER AND FERRULE OR ROLLER EQUIPPED THEREWITH

BACKGROUND OF THE INVENTION

The present invention relates to a guiding device for a printing sleeve or cylinder, particularly for flexographic printing as well as the sleeves or cylinders provided with this device.

In the case of sleeves for example, it is known that they have considerable advantages from a point of view of weight, when they are made of a composite material, but there remains a problem, of attaching printing plates to the peripheral surface of the sleeve.

Thus, the surface of the sleeves is precision ground to give it a suitable finished condition and above all such that the development, connected to the precision of the diameter, corresponds nicely to the desired development. However, it is necessary to avoid any false round which could militate against the precision of contact of the printing plate on the transfer roller or with the surface to be printed.

It is also known that printing plates must be perfectly positioned. These printing plates are thinner and thinner for evident reasons of material cost but also to improve the quality of the screen.

Because of this, as the quality increases and the length of delays in emplacing the sleeves are reduced, it is increasingly necessary to provide suitable means for holding the printing plate on the sleeve.

In a known manner, the printing plate is connected to the sleeve with double-faced adhesive. Reference marks are integrated in the printing plate at the time of manufacture, which reference marks are to be brought into coincidence with those on the sleeve.

After gluing the printing plate on the sleeve, it is necessary to cut the double-faced adhesive which protrudes, by cutting it off as evenly as possible. Most of the time, this cutting off is carried out manually by the operator, with the aid of a cutting blade, which has the immediate consequence of leading to score lines on the external coating of the sleeve.

When the wear is sufficiently great, it is generally necessary to send the sleeve to the factory to redo it, which, in addition to being a loss of time and a loss of use of the set of sleeves, is needlessly expensive.

Moreover, it is easy to see that the cutting-off is relatively delicate because any slip of the blade can lead to damage to the printing plate.

SUMMARY OF THE INVENTION

The present invention overcomes these drawbacks by means of an integrated guiding device for mounting printing plates and for cutting. The device is very practical for the user, and permits adjustments and cuts both along generatrices and along circumferences The device is of a cost altogether compatible with the price of the supports, sleeves or cylinders, whose amortization is almost immediate. The device is neutral relative to the mechanical resistance of the sleeve with the cylinder, and is also self-compensating as to balancing and is applicable to all products free from surface fibers.

To this end, according to the invention, there is disclosed an integrated guiding device for the emplacement and cutting, with the aid of a cutting tool, of a printing plate on a printing sleeve or cylinder, particularly for flexography.

The sleeve or cylinder has an external coating adapted to be deeply machined. The guiding device has at least one longitudinal guide, along a generatrix, and/or a peripheral guide, about a circumference, provided within a matrix of very hard material. The matrix is held within the thickness of the external coating.

According to a preferred embodiment, the matrix of very hard material is disposed in a throat machined in the thickness of the external coating.

More particularly, the throat comprises immobilization means in the thickness of the coating, for example a dovetail profile.

The guide has a cross-section adapted to the profile of that of the cutting tool.

According to another characteristic, the matrix is made of a polymeric material loaded with particles of metal and/or ceramic.

The invention also relates to the sleeve or cylinder provided with this device.

BRIEF DESCRIPTION OF THE DRAWINGS

The device according to the present invention will now be described in connection with a particular embodiment, which is non-limiting, with reference to the accompanying drawings, on which the different figures represent.

DESCRIPTION OF THE PREFERRED EMBODIMENTS

Figure 1:
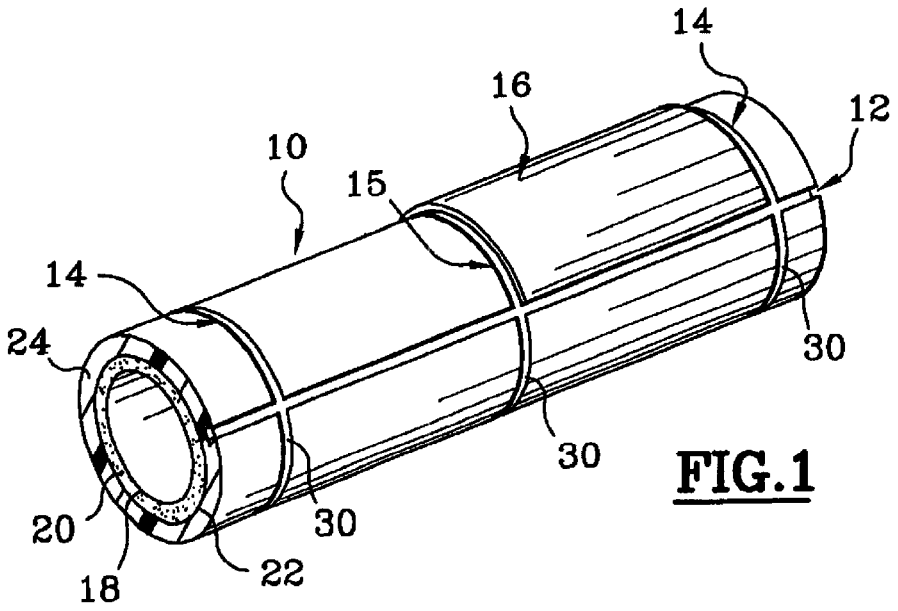
FIG. 1, a perspective view of a sleeve provided with a device for guiding and mounting and cutting according to the present invention, FIG. 2, a transverse cross-sectional view of the sleeve shown in FIG. 1, and FIGS. 3A to 3D, a sequence for production of such a sleeve.
Figure 2:
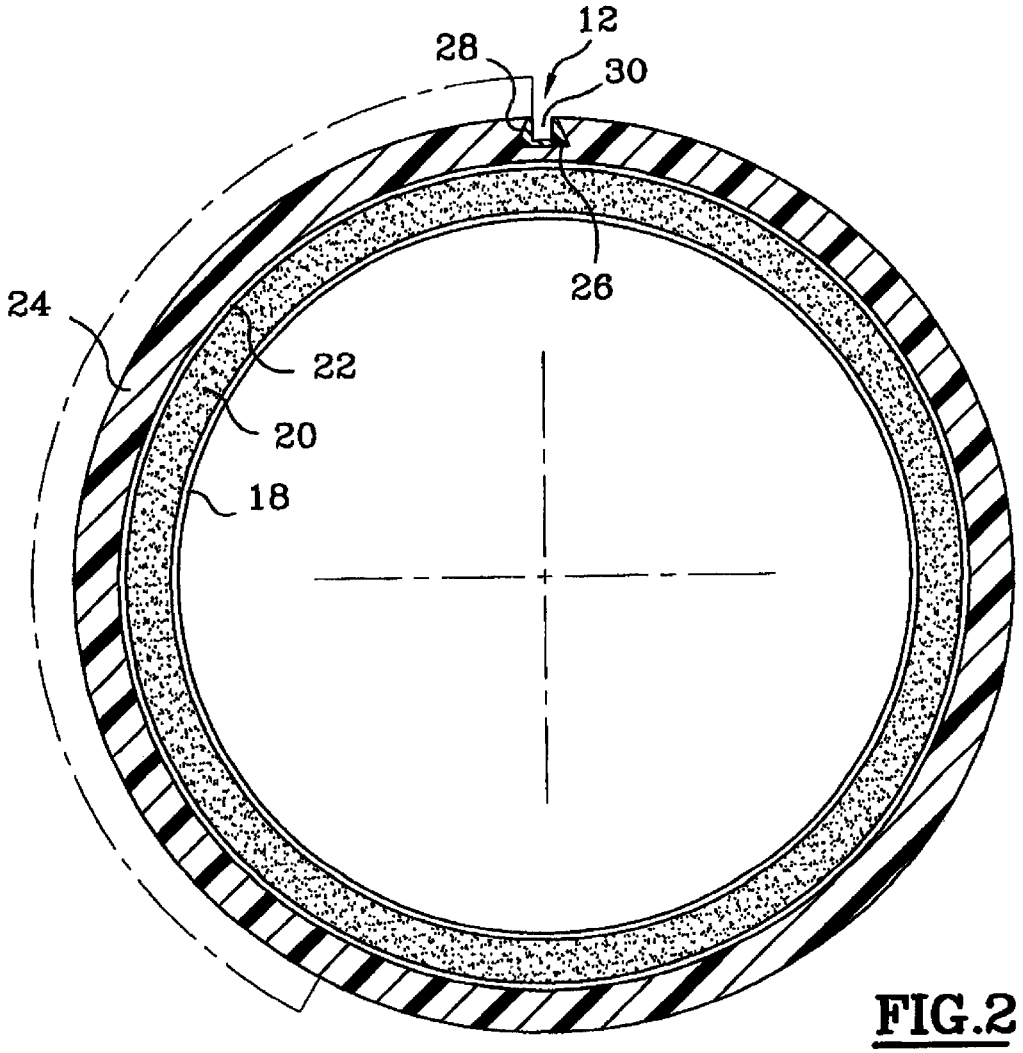

In FIG. 1, the sleeve 10 comprises a single longitudinal groove 12, two end peripheral grooves 14 and a medial peripheral groove 15 so as to limit the usable size of the design.

A printing plate 16 is connected to said sleeve by, for example, double-sided adhesive. The plate 16 extends between an end peripheral groove 14 and the medial peripheral groove 15.

The sleeve further comprises, an internal layer 18, made of fibers embodied in a resin, a layer 20 for thickness compensation, made of cellular material, a belt 22 of high rigidity and an external coating 24 of finishing resin permitting surfacing by precision grinding.

Such an arrangement of the sleeve is described in detail in patent application EP-A-683 040 in the name of the present assignee.

The device according to the invention is not limited to this type of embodiment of sleeve, but more generally is applicable to all sleeves or cylinders whose external coating is free from fibers and adapted to be machined.

Figure 3A:
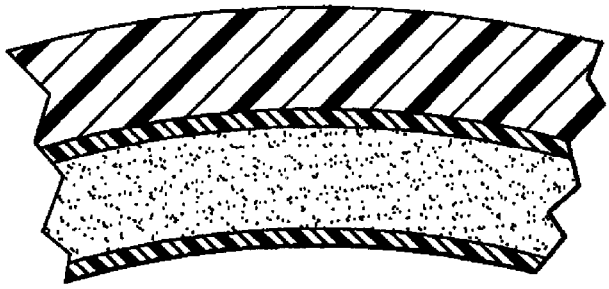

The embodiment of the device is described with respect to the sequence of FIGS. 3A to 3D. In FIG. 3A, the sleeve 10 is uncut, coming from production, and is previously finely ground.

Figure 3B:
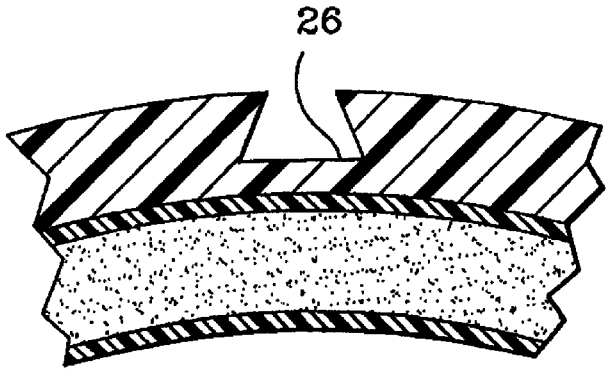
Figure 3C:
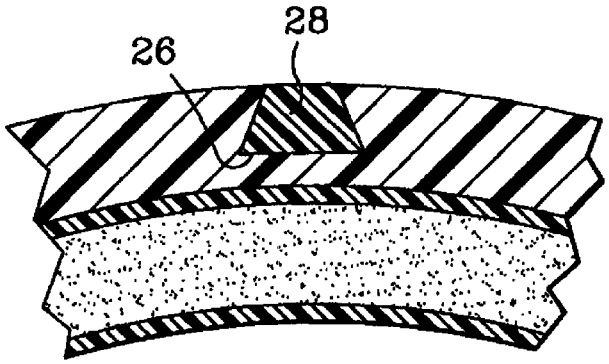
Figure 3D:
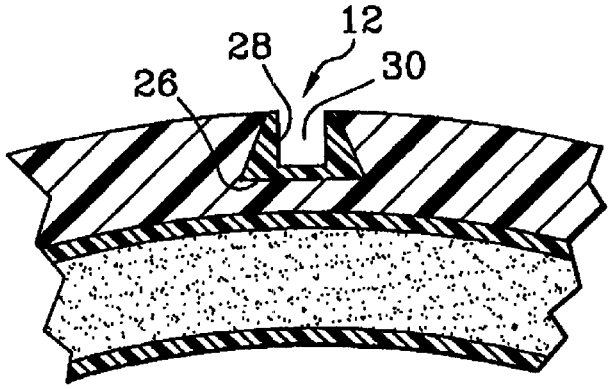

During the step of FIG. 3B, a dovetail throat 26 is machined, for example, into the sleeve 10.

This throat 26 is of a depth less than the thickness of the external coating.

In an alternative embodiment, not shown, the sleeve may comprise for example four grooves 12, equally spaced at 90° for evident reasons of symmetry.

Each throat 26 is then filled with a matrix 28 of a charged polymer type material, for example with metal or ceramic particles such that it gives a high hardness and resistance to friction. This step corresponds to that of FIG. 3C.

So as to facilitate sliding, the present invention proposes adding to the loaded polymer, a lubricant such as graphite and/or molybdenum bisulfide, these two examples not being considered limiting.

This matrix is for example fine ground, simultaneously with the final fine grinding of the sleeve, after polymerization of the matrix, to avoid any projecting particles.

Each matrix 28 is then ground in its central portion to form an integrated guide 30, whose widthwise cross-section corresponds to that of a cutter blade and whose depth is less than the thickness of the associated matrix 28. This machining is carried out with a diamond tool, given the hardness of the matrix of loaded polymer.

The dovetail profile gives a better integration of the associated matrix but is not a requirement, because the polymeric matrix has an excellent bond with the other resins constituting the external coating or cladding. It suffices to select resins compatible with those of the coating, which is within the skill of a person skilled in this art.

Other machining profiles can be envisaged for the production of the throat with notches or crenelations, but they complicate the production without giving further benefits.

Similarly, for a cylinder made of metal, for example of aluminum alloy, it can be useful to provide the device according to the invention because the alloy has a hardness quite often insufficient to permit guiding a cutting tool and moreover aluminum alloys are easily marked by the blade.

The advantage of using a polymer material is the easy emplacement in the throat and the final surface condition, which is adapted to be finely machined whilst offering possibilities of high hardness.

The end peripheral grooves 14 are at present used for cutting off any double-faced adhesive which overhangs them, when the printing plate is positioned.

What is claimed is:

1. An integrated guiding device for positioning a printing plate and for use with a cutting tool, said device comprising:

a sleeve having an external coating;

at least one of a longitudinal notch along a generatrix, and a peripheral notch about a circumference of said sleeve, the at least one notch guiding the cutting tool;

said at least one notch being in a matrix of material embedded in said external coating, said matrix being harder than said external coating.

2. The device according to claim 1, wherein the matrix is disposed in a throat machined in a thickness direction of said external coating.

3. The device according to claim 2, wherein the throat has a dovetail profile.

4. The device according to claim 1, wherein the notch has a cross-section matching a profile of the cutting tool.

5. The device according to claim 1, wherein the matrix is a polymeric material embedded with particles of at least one of a metal and ceramic.

6. The device according to claim 5, wherein the matrix further comprises a lubricant.

7. The device according to claim 6, wherein the lubricant is one of graphite and molybdenum bisulfide.

8. A sleeve for supporting a printing plate and for guiding a cutting tool, comprising:

machinable external coating;

a guiding device on said sleeve for positioning said printing plate, said guiding device having at least one of a longitudinal notch along a generatrix and a peripheral notch about a circumference of said sleeve; and said at least one notch guiding a cutting tool.

* * * * *